US008100708B2

(12) United States Patent
Kataoka et al.

(10) Patent No.: US 8,100,708 B2
(45) **Date of Patent: *Jan. 24, 2012**

(54) CONNECTION STRUCTURE FOR A VEHICLE

(75) Inventors: Yuta Kataoka, Hitachi (JP); Hideaki Takehara, Hitachi (JP); Kunihiro Fukuda, Tsukuba (JP); Sachio Suzuki, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/801,428

(22) Filed: Jun. 8, 2010

(65) Prior Publication Data

US 2011/0130023 A1 Jun. 2, 2011

(30) Foreign Application Priority Data

Nov. 30, 2009 (JP) ..... 2009-272316

(51) Int. Cl.
*H01R 13/62* (2006.01)

(52) U.S. Cl. ..... 439/271

(58) Field of Classification Search ..... 439/345, 439/271, 157, 152, 160, 161, 196
See application file for complete search history.

(56) References Cited

U.S. PATENT DOCUMENTS

2009/0075506 A1 3/2009 Suzuki

FOREIGN PATENT DOCUMENTS

| | | | |
|---|---|---|---|
| JP | 2001-203021 | A | 7/2001 |
| JP | 2004-56924 | A | 2/2004 |
| JP | 4037199 | B2 | 1/2008 |
| JP | 2009-70754 | A | 4/2009 |

*Primary Examiner* — Alexander Gilman
(74) *Attorney, Agent, or Firm* — McGinn IP Law Group, PLLC

(57) ABSTRACT

A connector has a first terminal housing with first connecting terminals aligned and accommodated therein, a second terminal housing with second connecting terminals aligned and accommodated therein, isolating plates and a connecting member. Each of the first connecting terminals and each of the second connecting terminals are surface-roughened such that a surface facing to other connecting terminal and composing a contact with the other connecting terminal provides a first frictional coefficient. When each of the isolating plates is adjacent to each of the first connecting terminals, each of the isolating plates is integrally fixed to each of the first connecting terminals, and when each of the isolating plates is adjacent to each of the second connecting terminals, each surface of the isolating plates facing to each of the second connecting terminals is surface-roughened to provide a second frictional coefficient.

18 Claims, 5 Drawing Sheets

CONNECTION STRUCTURE FOR A VEHICLE

The present application is based on Japanese patent application No. 2009-272316 filed on Nov. 30, 2009, the entire contents of which are incorporated herein by reference.

BACKGROUND OF THE INVENTION

1. Field of the Invention

The present invention relates to a connection structure for a vehicle, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, e.g. between a motor and an inverter or between the inverter and a battery, has at its one end a connector, which consists of two separate portions: a male connector portion with a male terminal and a first terminal housing accommodating that male terminal, and a female connector portion with a female terminal connected with the male terminal and a second terminal housing accommodating that female terminal. For example, Japanese Patent Laid-Open No. 2009-070754 (JP-A 2009-070754) discloses a connector having the aforementioned structure.

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which is disclosed by JP Patent No. 4037199, has been known in the art.

JP Patent No. 4037199 discloses an electrical connection structure for a vehicle, which is for connecting multiphase connecting terminals of a conductive member drawn out from a motor for driving the vehicle, and multiphase connecting terminals of a power line cable drawn out from an inverter for driving the motor, in which each phase connecting terminal of the conductive member and each corresponding phase connecting terminal of the power line cable are overlapped, and isolating plates are disposed on opposite surfaces to overlapped surfaces of the connecting terminals, respectively, and these overlapped connecting terminals and isolating plates are collectively fastened in an overlapping direction with a single bolt provided in a position to penetrate these overlapped connecting terminals and isolating plates.

That is, in the technique used in the electrical connector disclosed by JP Patent No. 4037199, the single bolt is tightened in the overlapping direction, to collectively hold the multiplicity of contacts between the connecting terminals, which are the overlapped surfaces of the connecting terminals, and thereby fix the connecting terminals at the contacts therebetween, for electrical connections between the connecting terminals, respectively. This configuration disclosed by JP Patent No. 4037199 is effective in easily ensuring size reduction, compared to a technique disclosed by JP-A-2009-070754.

Further, Japanese Patent Laid-Open No. 2001-203021 (JP-A 2001-233021) discloses one example of prior arts.

Herein, a power harness used for vehicles is used on-vehicle which is a vibrational environment. According to this background, the connecting terminals tend to be moved relatively due to fretting (micro sliding), so that prevention of fretting corrosion at contacts is one of technical problems.

However, an effective means for preventing the fretting corrosion at the contacts has not been achieved in the structure shown by Japanese Patent No. 4037199.

SUMMARY OF THE INVENTION

Accordingly, the object of the present invention is to provide a connection structure for a vehicle, in which a plurality of first connecting terminals, a plurality of second connecting terminals and a plurality of isolating plates are alternately interleaved to provide a stacked structure, in order to reduce the fretting corrosion at the contacts.

According to a feature of the invention, a connection structure for a vehicle comprises:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, when the first terminal housing and the second terminal housing being mated with each other, the first connecting terminals and the second connecting terminals facing each other to form pairs, respectively, and resulting in a stacked structure of the isolating plates being sandwiched between the pairs of the first connecting terminals and the second connecting terminals, respectively; and a connecting member for pressing the adjacent isolating plate, to thereby collectively fix the first connecting terminals and the second connecting terminals at the contacts therebetween, for electrical connections between the first connecting terminals and the second connecting terminals, respectively, in which each of the first connecting terminals and each of the second connecting terminals are surface-roughened such that a surface facing to other connecting terminal composing a contact provides a first frictional coefficient, in which when each of the isolating plates is adjacent to each of the first connecting terminals, each of the isolating plates is integrally fixed to each of the first connecting terminals, and when each of the isolating plates is adjacent to each of the second connecting terminals, each surface of the isolating plates facing to each of the second connecting terminals is surface-roughened to provide a second frictional coefficient, in which each of the first connecting terminals, each of the second connecting terminals and each of the isolating plates are integrally coupled with each other to suppress movement relative to each other against fretting, when each contact between the first connecting terminals and the second connecting terminals and the isolating plates are pressed by the connecting member.

According to another feature of the invention, a connection structure for a vehicle comprises:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, when the first terminal housing and the second terminal housing being mated with each other, the first connecting terminals and the second connecting terminals facing each other to form pairs, respectively, and resulting in a stacked structure of the isolating plates being sandwiched between the pairs of the first connecting terminals and the second connecting terminals, respectively; and a connecting member for pressing the adjacent isolating plate, to thereby collectively fix the first connecting terminals and the second connecting terminals at the contacts therebetween, for electrical connections between the first connecting terminals and the second connecting terminals, respectively, in which each of the first connecting terminals and each of the second connecting terminals are surface-roughened such that a surface facing to other connecting terminal composing a contact provides a first frictional coefficient, in which when each of the isolating plates is adjacent to each of the first connecting terminals, each of the isolating plates is integrally fixed to each of the first connecting terminals, and when each of the isolating plates is adjacent to each of the second connecting terminals, a metallic plate having a roughened surface to provide a second frictional coefficient is provided on a surface of each of the isolating plates facing to each of the second connecting terminals, in which each of the first connecting terminals, each of the second connecting terminals and each of the isolating plates are integrally coupled with each other to suppress movement relative to each other against fretting, when each contact between the first connecting terminals and the second connecting terminals and the isolating plates are pressed by the connecting member.

The first terminal housing may comprise a male terminal housing, the second terminal housing may comprise a female terminal housing, and the second terminal housing may further comprise a through-hole configured to allow the connecting member to be inserted into and removed from the first terminal housing after the first terminal housing and the second terminal housing are mated.

The first frictional coefficient and the second frictional coefficient may be substantially identical to each other.

A flexible cable may be connected to one end of each of the second connecting terminals and the second terminal housing, and the second terminal housing may be provided with a cable holding member that allows the second connecting terminals to be held with flexibility at specified positions respectively by holding the cable.

The connecting member may comprise a head and a shaft connected to the head, the shaft penetrates each contact between the first connecting terminals and the second connecting terminals as well as the isolating plates, the head may press the adjacent isolating plate, to thereby collectively fix the first connecting terminals and the second connecting terminals at the contacts therebetween, and at least a portion of the connecting member, which penetrates each contact, may be formed of an insulating material.

A connecting member insertion hole for inserting the connecting member may be formed in the first terminal housing, at least a portion of the shaft, which penetrates the first connecting terminals and the second connecting terminals, has a surface formed of an insulating material, the head is integrally formed with the shaft, and a waterproofing structure for sealing between an outer surface of the head and an inner surface of the connecting member insertion hole in the male terminal housing is provided in an outer surface of the head of the connecting member.

Advantages of the Invention

According to the invention, it is possible to reduce the fretting corrosion at the contacts, in the connection structure for a vehicle, in which a plurality of first connecting terminals, a plurality of second connecting terminals and a plurality of isolating plates are alternately interleaved to provide a stacked structure, since the respective first connecting terminals, the respective second connecting terminals and the respective isolating plates are integrally coupled with each other to suppress movement relative to each other against the fretting.

Particularly, when the first connecting terminals are adjacent to each other, it is possible to reduce locations where the fretting occurs by adopting a structure for integrally fixing the isolating plates to the first connecting terminals, so that it is possible to reduce the fretting corrosion at the contacts more effectively.

BRIEF DESCRIPTION OF THE DRAWINGS

The preferred embodiments according to the invention will be explained below referring to the drawings, wherein:

FIGS. 7A and 7B are explanatory diagrams showing a second connecting terminal, wherein FIG. 7A is a side view thereof and FIG. 7B is a bottom view thereof;

FIGS. 8A and 8B are explanatory diagrams showing a second connecting terminal, wherein FIG. 8A is a side view thereof and FIG. 8B is a bottom view thereof;

FIG. 6 is a cross sectional view showing the second connector portion;

FIGS. 7A and 7B are explanatory diagrams showing a second connecting terminal, wherein FIG. 7A is a side view thereof and FIG. 7B is a bottom view thereof;

FIGS. 8A and 8B are explanatory diagrams showing the second connecting terminal, wherein FIG. 8A is a side view thereof and FIG. 8B is a bottom view thereof;

FIGS. 9A and 9B are explanatory diagrams showing a first example of surface roughening of the first connecting terminal and an isolating plate, wherein FIG. 9A is a plan view thereof, and FIG. 9B is a bottom view thereof;

FIGS. 10A and 10B are explanatory diagrams showing a second example of surface roughening of the first connecting terminal and an isolating plate, wherein FIG. 10A is a plan view thereof, and FIG. 10B is a bottom view thereof;

FIGS. 11A and 11B are explanatory diagrams showing a third example of surface roughening of the first connecting terminal and an isolating plate, wherein FIG. 11A is a plan view thereof, and FIG. 11B is a bottom view thereof;

DETAILED DESCRIPTION OF THE PREFERRED EMBODIMENTS

Next, preferred embodiments according to the present invention will be explained below in more detail in conjunction with appended drawings.

First Embodiment

Firstly, the first embodiment according to the present invention will be explained below.

Herein, a connector is explained as one example of the connection structure for a vehicle of the present invention.

Figure 1:
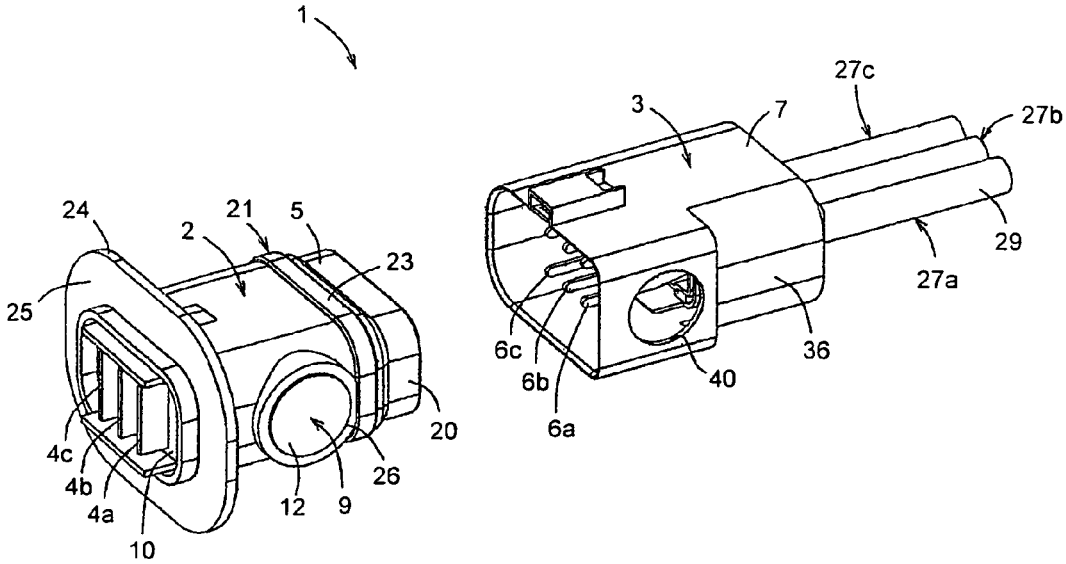
FIG. 1 is a perspective view showing a first connector portion and a second connector portion composing a connector in a first embodiment according to the present invention.
Figure 2:
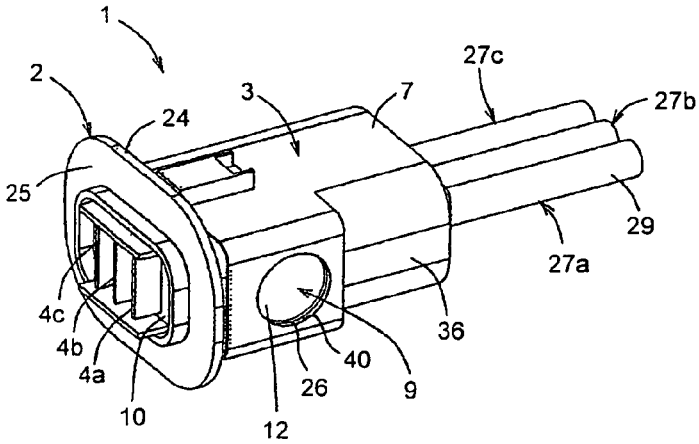
FIG. 2 is a perspective view showing the connector when the first connector portion and the second connector portion are mated.
Figure 3:
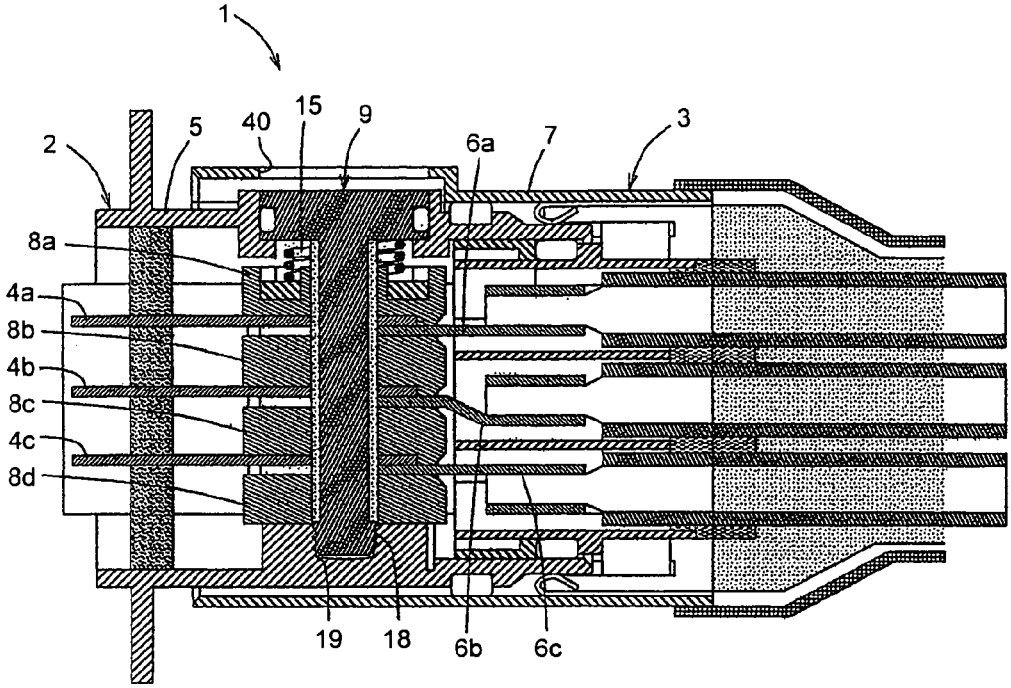
FIG. 3 is a cross sectional view of the connector when the first connector portion and the second connector portion are mated.

FIG. 1 is a perspective view showing a first connector portion 2 and a second connector portion 3 composing a connector 1 in the first embodiment according to the present invention. FIG. 2 is a perspective view showing the connector 1 when the first connector portion 2 and the second connector portion 3 are mated. FIG. 3 is a cross sectional view of the connector 1 when the first connector portion 2 and the second connector portion 3 are mated. In FIGS. 1 and 2, a recess to which a hexagon wrench (hexagonal spanner) is mated is formed at an upper surface of a head portion 9*a* of a bolt 12 as a connecting member 9, however, the recess is omitted therein.

(The Connector 1 Structure)

As shown in FIGS. 1 to 3, the connector 1 in this embodiment comprises a first connector portion 2 and a second connector portion 3 mated with each other, to thereby collectively connect a plurality of power lines.

More specifically, the connector 1 includes the first connector portion 2 having a first terminal housing 5 with a plurality of (three) first connecting terminals (male terminals) 4*a* to 4*c* aligned and accommodated therein, the second connector portion 3 having a second terminal housing 7 with a plurality of (three) second connecting terminals (female terminals) 6*a* to 6*c* aligned and accommodated therein, and isolating plates 8*a* to 8*d* aligned and accommodated in the first terminal housing 5. When the first terminal housing 5 of the first connector portion 2 and the second terminal housing 7 of the second connector portion 3 are mated with each other, the first connecting terminals 4*a* to 4*c* and the second connecting terminals 6*a* to 6*c* face each other to form pairs respectively (i.e. a pair of the first connecting terminal 4*a* and the second connecting terminal 6*a*, a pair of the first connecting terminal 4*b* and the second connecting terminal 6*b*, and a pair of the first connecting terminal 4*c* and the second connecting terminal 6*c*, respectively), and result in a stacked structure of the pairs of the first connecting terminals 4*a* to 4*c* and the second connecting terminals 6*a* to 6*c* that are sandwiched by the isolating plates 8*a* to 8*d*.

Namely, the connector 1 in the first embodiment comprises a connector in which the first connecting terminals 4*a* to 4*c*, the second connecting terminals 6*a* to 6*c* and the isolating plates 8*a* to 8*d* are interleaved to provide the stacked structure when the first terminal housing 5 of the first connector portion 2 and the second terminal housing 7 of the second connector portion 3 are mated with each other.

This connector 1 is used for connection of a vehicle drive motor and an inverter for diving that motor, for example.

More specifically, the first terminal housing 5 of the first connector portion 2 (in FIG. 1, left side portion) is mated with a shield case of the motor, and the first connecting terminal 4*a* to 4*c* portions exposed from the first terminal housing 5 are connected to terminals, respectively, of a terminal block installed in the shield case of the motor. Mating to this first connector portion 2 the second connector portion 3 electrically connected with the inverter results in electrical connection of the motor and the inverter. Although the foregoing is concerned with the motor side connection, the same applies to the inverter side connection.

(First and Second Connector Portions 2 and 3)

Below are described the respective specific structures of the first connector portion 2 and the second connector portion 3.

(First Connector Portion 2)

Figure 4:
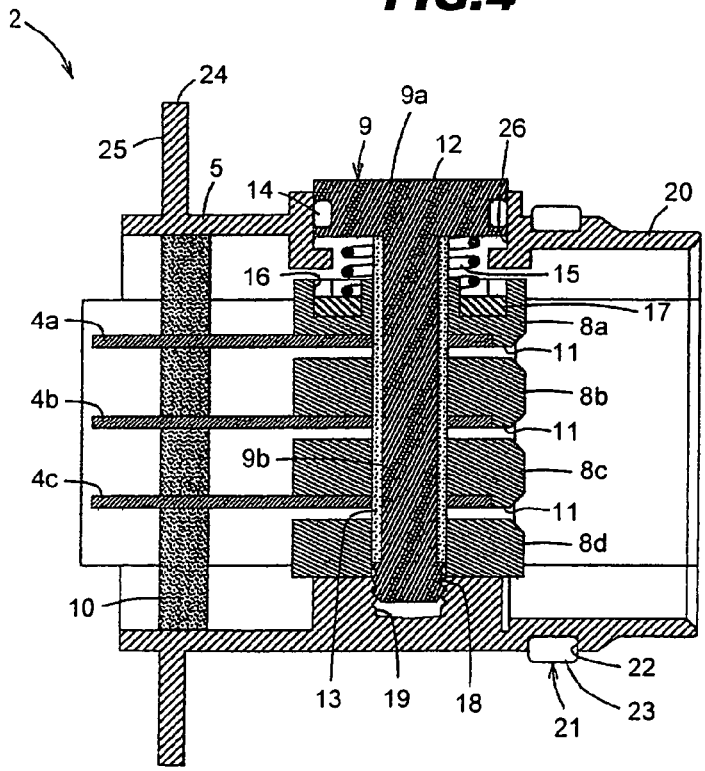
FIG. 4 is a cross sectional view of the first connector portion.

Referring to FIG. 4, the first connector portion 2 has the three first connecting terminals 4*a* to 4*c* held therein to be aligned at a specified pitch, and includes the first terminal housing 5 for accommodating the three aligned first connecting terminals 4*a* to 4*c*, substantially rectangular parallelepiped isolating plates 8*a* to 8*d* provided in the first terminal housing 5 for isolating each of the first connecting terminals 4*a* to 4*c*, and a connecting member 9 with a head 9*b* and a shaft 9*b* connected to the head 9*b*, whose shaft 9*b* penetrates each contact between the first connecting terminals 4*a* to 4*c* and the second connecting terminals 6*a* to 6*c* and the isolating plates 8*a* to 8*d*, and whose head 9*b* is pressed against the adjacent isolating plate 8*a*, to thereby collectively fix the first connecting terminals 4*a* to 4*c* and the second connecting terminals 6*a* to 6*c* at the contacts therebetween, for electrical connections between the first connecting terminals 4*a* to 4*c* and the second connecting terminals 6*a* to 6*c*, respectively. At least a portion which penetrates each contact comprises a connecting member 9 formed of an insulating material.

The first terminal housing 5 may be a male housing (male side housing) or a female housing (female side housing). Herein, the case that the first terminal housing 5 is the male side housing is explained as an example.

(First Connecting Terminals 4*a* to 4*c*)

The first connecting terminals 4*a* to 4*c* are plate terminals, and are held to be aligned at a specified pitch by being spaced apart from each other by a molded resin material 10 formed of an insulating resin (e.g. PPS (polyphenylene sulfide) resin, PPA (polyphthalamide) resin, PA (polyamide) resin, PBT (polybutylene terephthalate), epoxy based resin), which forms a portion of the first terminal housing 5. As a method for holding the first connecting terminals 4*a* to 4*c* with the molded resin material 10, there is a holding method by inserting the first connecting terminals 4*a* to 4*c* during molding of the molded resin material 10 and then curing the resin, or a holding method by pressing the first connecting terminals 4*a* to 4*c* into the molded resin material 10 which has been molded beforehand.

The first connecting terminals 4*a* to 4*c* are supplied with electricity at different voltages and/or currents, respectively. For example, in this embodiment, power lines are assumed to be for three phase alternating current between a motor and an inverter, so that the first connecting terminals 4*a* to 4*c* are supplied with alternating currents, respectively, which are 120 degrees out of phase with each other. For the purpose of reducing the loss of power transmitted through the connector 1, the first connecting terminals 4*a* to 4*c* may each be formed of a metal such as a high conductivity silver, copper, aluminum, or the like. Also, the first connecting terminals 4*a* to 4*c* each have slight flexibility.

(Isolating Plates 8*a* to 8*d*)

The isolating plates 8*a* to 8*d* comprise the plurality of first isolating plates 8*a* to 8*c* aligned and accommodated in the first terminal housing 5, and integrally fixed to one side of the first connecting terminals 4*a* to 4*c*, respectively, (i.e. to the opposite side to the side joined with the second connecting terminals 6*a* to 6*c*), and the second isolating plate 8*d* provided to be integrally fixed to an inner surface of the first terminal housing 5, and to face one side of the second connecting terminal 6*c* (i.e. the opposite side to the side joined with the first connecting terminal 4*c*) positioned at the outermost side when stacking the first connecting terminals 4*a* to 4*c* and the second connecting terminals 6*a* to 6*c*.

The isolating plates 8*a* to 8*d* are fixed at such a position as to protrude from the tips of the first connecting terminals 4*a* to 4*c*. Each of these isolating plates 8*a* to 8*d* is chamfered at each of its corners on the second connecting terminal 6*a* to 6*c* inserting/removing side.

Figure 5:
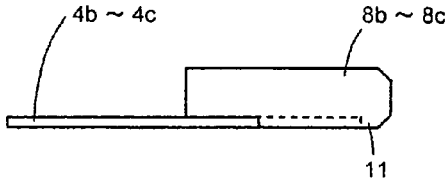
FIG. 5 is a side view of a first connecting terminal.

Also, referring to FIG. 5, each of the first isolating plates 8*a* to 8*c* is formed with a protruding portion (thickened surface) 11 of its surface fixed to the first connecting terminals 4*a* to 4*c* to fill the level difference therebetween, so that the lower surfaces (in the figure, the lower sides) of the first isolating plates 8*a* to 8*c* are coplanar with the lower surfaces (in the figure, the lower sides) of the first connecting terminals 4*a* to 4*c*, respectively. With this configuration, when the first connector portion 2 and the second connector portion 3 are mated with each other, the tips of the first connecting terminals 4*a* to 4*c* do not contact the inserted tips of the second connecting terminal 6*a* to 6*c*. The insertability of the second connecting terminal 6*a* to 6*c* is therefore enhanced. In FIG. 5, the first connecting terminals 4*b* and 4*c* and the first isolating plates 8*b* and 8*c* are shown as example.

(Connecting Member 9)

Referring again to FIG. 4, the connecting member 9 has the shaft 9*a* with a portion, which penetrates each contact between the plural first connecting terminals 4*a* to 4*c* and the plural second connecting terminals 6*a* to 6*c*, formed of an insulating material, and the head 9*b* formed integrally with the shaft 9*a*, which serves as a pressing portion to be pressed against the adjacent first isolating plate 8*a*.

More specifically, the connecting member 9 comprises a bolt (cap bolt) 12 made of a metal (e.g. SUS, iron, copper alloy, or the like) and an insulating layer 13 formed of an insulating resin material (e.g. PPS (polyphenylene sulfide) resin, PPA (polyphthalamide) resin, PA (polyamide) resin, PBT (polybutylene terephthalate), epoxy based resin), which coats a perimeter of the shaft 9*b* (including the portion penetrating each contact) of that bolt 12.

The entire connecting member 9 formed of an insulating resin may be used, but the connecting member 9 coated with the insulating layer 13 around the perimeter of the shaft 9*b* of the metallic bolt 12 is preferable from the point of view of strength. That is, the connecting member 9 having a combined structure of the metallic bolt 12 and the insulating layer 13 made of an insulating resin can have enhanced strength, compared to the entire connecting member 9 formed of an insulating resin. As the insulating resin for coating the metallic bolt 12, it is preferred to use an insulating resin, which has a linear expansion coefficient approximate to a linear expansion coefficient of a metal forming the bolt 12, so as to prevent creep.

The head 9*b* of the connecting member 9 is provided with a packing 14 therearound for preventing water from penetrating into the first terminal housing 5. Also, between the lower surface of the head 9*b* of the connecting member 9 and the upper surface of the first isolating plate 8*a* directly therebelow is provided an elastic member 15 for applying a specified pressing force to the first isolating plate 8*a*. The elastic member 15 is a spring made of a metal (e.g. SUS, or the like). In this embodiment, the elastic member 15 constitutes a portion of the connecting member 9.

The first isolating plate 8*a* to be in contact with a lower portion of the elastic member 15 is formed with a recessed portion 16 in its upper surface which covers (accommodates) the lower portion of the elastic member 15. At the bottom of the recessed portion 16 (i.e. the base to be in contact with the lower portion of the elastic member 15) is provided a receiving member 17 made of a metal (e.g. SUS, or the like) which receives the elastic member 15 and which is for preventing damage to the first isolating plate 8*a* formed of an insulating resin.

This connecting member 9 is inserted into the first terminal housing 5 from above the first connecting terminal 4*a* to 4*c* surfaces (in FIG. 4, the upper surfaces) to which are fixed the first isolating plates 8*a* to 8*c*, respectively. A screwing portion 18 at a tip of the shaft 9*b* is then screwed into a screw hole 19 formed in an inner surface of the first terminal housing 5, to thereby allow the connecting member 9 to press the first connecting terminals 4*a* to 4*c* and the second connecting terminals 6*a* to 6*c* from its head 9*b* toward the tip of its shaft 9*b* (in FIG. 4, downward from above), and collectively fix the first connecting terminals 4*a* to 4*c* and the second connecting terminals 6*a* to 6*c* at the contacts therebetween, for electrical connections between the first connecting terminals 4*a* to 4*c* and the second connecting terminals 6*a* to 6*c*, respectively.

(First Terminal Housing 5)

The first terminal housing 5 is formed of a cylindrical hollow body 20 which is substantially rectangular in transverse cross section. An outer portion at one end (in the figure, at the right end) of the cylindrical body 20 mated with the second terminal housing 7 is formed in a tapered shape, taking the mateability with the second connector portion 3 into consideration. Also, in the outer portion at one end of the cylindrical body 20 is provided a terminal housing waterproofing structure 21 for sealing between the first connector portion 2 and the second connector portion 3. The terminal housing waterproofing structure 21 is formed of a recessed portion 22 formed in an outer portion at the open end of the cylindrical body 20, and a packing 23 provided in the recessed portion 22, such as an O-ring.

In the other end (in the figure, in the left end) of the cylindrical body 20 is accommodated a molded resin material 10 with the first connecting terminals 4*a* to 4*c* aligned and held therewith. In an outer portion at the other end of the cylindrical body 20 is formed a flange 24 (an attachment hole omitted) for fixing the first connector portion 2 to a device casing (e.g. a motor shield case). At a rim 25 of the flange 24 having the attachment hole for bolt insertion and fixation to a device casing may be provided a packing for sealing between the first connector portion 2 and the device casing. The structure of this flange 24 is not assumed as fixing the first connector portion 2 to a device casing, but the flange 24 may be provided in the second connector portion 3, or in both the first connector portion 2 and the second connector portion 3. Also, both of the first connector portion 2 and the second connector portion 3 may be free or not fixed to a device casing.

Also, this flange 24 is effective in enhancing the dissipation of heat. That is, the formation of the flange 24 permits a large surface area of the first terminal housing 5, thereby allowing enhancement in the dissipation to outside via the first terminal housing 5, of heat produced inside the first connector portion 2 (e.g. heat produced at each contact).

In an upper portion (in the figure, in the upper side) of the cylindrical body 20 is formed a connecting member insertion hole 26 for inserting the connecting member 9. The connecting member insertion hole 26 is formed in a cylindrical shape, and bent inward at a lower end (in the figure, at the lower side) of that cylindrical shape. A rim of the lower surface of the head 9*b* of the connecting member 9 is contacted with this bent portion of the connecting member insertion hole 26, to thereby regulate the stroke of the connecting member 9.

For shielding performance, heat dissipation, and weight reduction of the connector 1, the cylindrical body 20 is formed of, preferably a high electrical conductivity, high thermal conductivity and lightweight metal such as an aluminum, but may be formed of a resin, or the like. In the case that the first terminal housing 5 is formed of an insulating resin, the second isolating plate 8*d* and the first terminal housing 5 may integrally be formed of the insulating resin. The cylindrical body 20 formed of an aluminum as mentioned above allows the connecting member 9 to be firmly tightened into the screw hole 19 when screwed thereinto, compared with the cylindrical body 20 formed of an insulating resin.

(Second Connector Portion 3)

Figure 6:
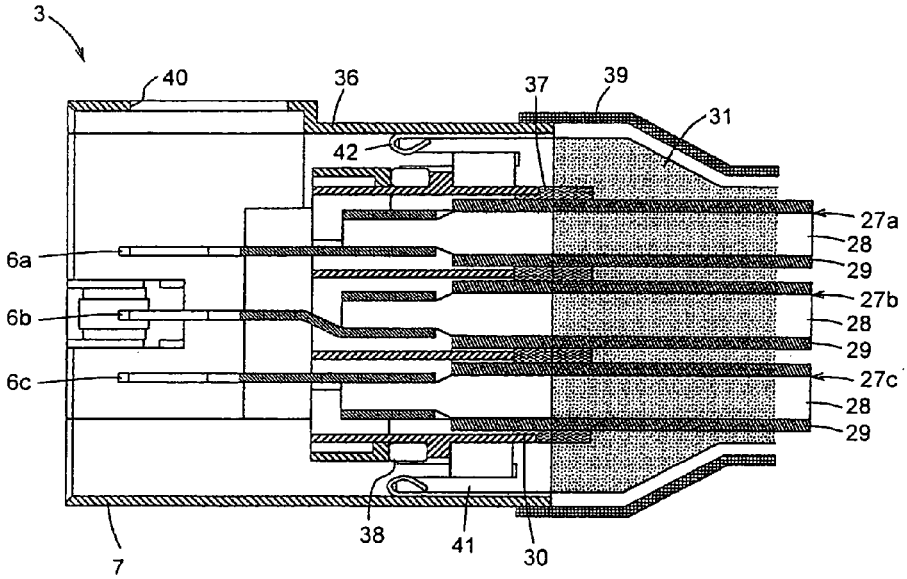
FIG. 6 is a cross sectional view of the second connector portion.

Referring to FIG. 6, the second connector portion 3 has the second terminal housing 7 with a plurality of (three) second connecting terminals (female terminals) 6*a* to 6*c* aligned and accommodated therein. Herein, a connector portion on the female terminal side is called as "second connector portion 3". The second terminal housing 7 may be a male housing (male side housing) or a female housing (female side housing). Herein, the case that the second terminal housing 7 is the female side housing is explained as an example.

The second connecting terminals 6*a* to 6*c* are connected with cables 27*a* to 27*c*, respectively, at one end, which extend from an inverter. These cables 27*a* to 27*c* are electrically connected to the first connecting terminals 4*a* to 4*c* via the second connecting terminals 6*a* to 6*c*, respectively, and therefore supplied with electricity at voltages and/or currents in correspondence to the second connecting terminals 6*a* to 6*c*, respectively. The cables 27*a* to 27*c* are constructed by forming an insulating layer 29 around a conductor 28. In this embodiment, the conductor 28 used has a cross section of 20 $mm^2$.

The cables 27*a* to 27*c* are held to be aligned at a specified pitch by a multi-cylindrical (i.e. plurality of cylinders are aligned) cable holding member 30. With this cable holding member 30, when the first connector portion 2 and the second connector portion 3 are mated with each other, the second connecting terminals 6*a* to 6*c* are held to be positioned below the first connecting terminals 4*a* to 4*c* to face (i.e. to be connected to) the second connecting terminals 6*a* to 6*c* to form pairs respectively.

The cable holding member 30 is formed of an insulating resin, to isolate the second connecting terminals 6*a* to 6*c* from each other to prevent a short circuit. This cable holding member 30 allows the second connecting terminals 6*a* to 6*c* to be held at specified positions respectively, even when the cables 27*a* to 27*c* respectively connected to the second connecting terminals 6*a* to 6*c* have excellent flexibility. That is, in this embodiment, the cables 27*a* to 27*c* to be used can have excellent flexibility, and therefore enhance a degree of freedom of wiring the cables 27*a* to 27*c*.

Although the second connecting terminals 6*a* to 6*c* are positioned by the cable holding member 30 holding the cables 27*a* to 27*c*, more specifically, the ends near the second connecting terminals 6*a* to 6*c* of the cables 27*a* to 27*c* to hold the second connecting terminals 6*a* to 6*c* at specified positions respectively, the second connecting terminals 6*a* to 6*c* may be positioned by the cable holding member 30 holding the cables 27*a* to 27*c*, and the second connecting terminals 6*a* to 6*c* directly. Also, a connecting terminal holding member may, in place of the cable holding member 30, be used that holds not the cables 27*a* to 27*c*, but the second connecting terminals 6*a* to 6*c* directly.

In the case that, with the cable holding member 30, the second connecting terminals 6*a* to 6*c* are positioned by holding the cables 27*a* to 27*c* without directly holding the second connecting terminals 6*a* to 6*c*, that is, in the case of this embodiment, making the cables 27*a* to 27*c* flexible allows the tips of the second connecting terminals 6*a* to 6*c* to have flexibility relative to the second terminal housing 7. This construction permits flexible adaptation, even to deformation of first connecting terminal 4*a* to 4*c* portions to insert the second connecting terminals 6*a* to 6*c* in the first connector portion 2, when pressed by the connecting member 9.

Also, a braided shield 31 is wrapped around cables 27*a* to 27*c* portions drawn out of the second terminal housing 7, for the purpose of enhancement in shielding performance. This braided shield 31 is contacted with a later-described cylindrical shield body 41, and electrically connected to the first terminal housing 5 (to be equipotential (GND)) through the cylindrical shield body 41. The braided shield 31 is not shown in FIGS. 1 and 2 for simplification.

(Second Connecting Terminals 6*a* to 6*c*)

Figure 7A:
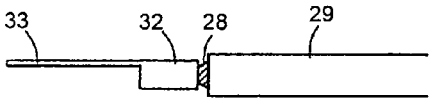
Figure 7B:
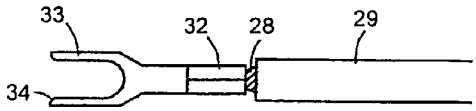
Figure 8A:
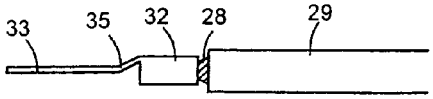
Figure 8B:
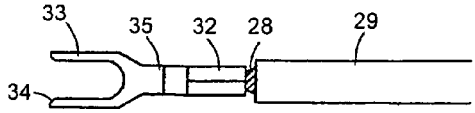
Figure 9A:
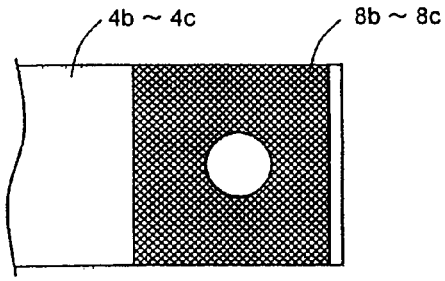
Figure 9B:
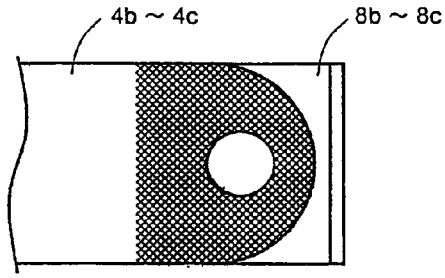
Figure 10A:
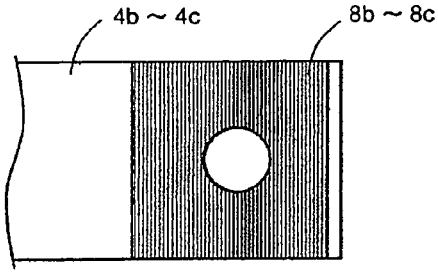
Figure 10B:
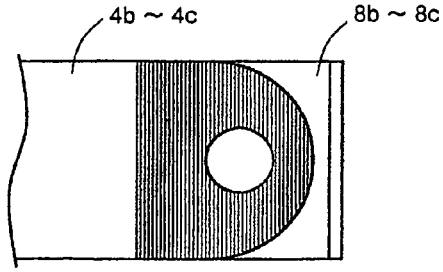
Figure 11A:
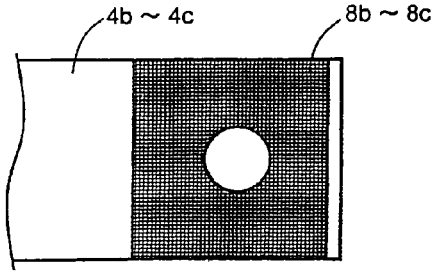
Figure 11B:
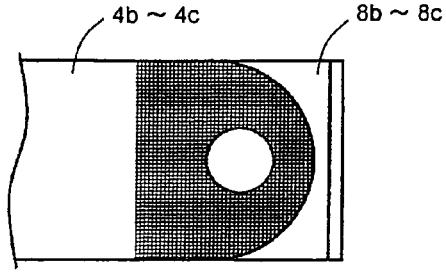

Referring to FIGS. 7 and 8, the second connecting terminals 6*a* to 6*c* respectively include calking portions 32 for calking the conductors 28 exposed from the tips of the cables 27*a* to 27*c*, and U-shaped contacts 33 formed integrally with the calking portions 32. At tips of the U-shaped contacts 33 are respectively formed tapered portions 34 to enhance the insertability of the U-shaped contacts 33. When the first connector portion 2 and the second connector portion 3 are mated with each other, the U-shaped contacts 33 are inserted in such a manner as to grip the shaft 9*b* of the connecting member 9.

In this embodiment, to reduce the size of the connector 1, the cables 27*a* to 27*c* are configured to be aligned and held as close to each other as possible. To this end, as shown in FIG. 8, a trunk 35 of the second connecting terminal 6*b* to be connected to the cable 27*b* arranged in the middle when aligned is bent, to thereby space the second connecting terminals 6*a* to 6*c* apart at the same pitch.

The second connecting terminals 6*a* to 6*c* may each be constructed of a high electrical conductivity metal such as silver, copper, aluminum, or the like, in order to reduce the loss of power transmitted through the connector 1. Also, the second connecting terminals 6*a* to 6*c* each have slight flexibility.

(Second Terminal Housing 7)

Referring again to FIG. 6, the second terminal housing 7 is formed of a cylindrical hollow body 36 which is substantially rectangular in transverse cross section. To mate the first terminal housing 5 into the second terminal housing 7, an inner portion at one end (in the figure, at the left end) of the cylindrical body 36 mated with the first terminal housing 5 is formed in a tapered shape, taking the mateability with the first terminal housing 5 into consideration.

Alternatively, the first terminal housing 5 and the second terminal housing 7 may be configured such that the second terminal housing 7 is mated into the first terminal housing 5, contrary to the above case. In this case, an inner portion at one end of the cylindrical body 20 composing the first terminal housing 5 may be formed in a tapered shape, an outer portion at one end of the cylindrical body 36 composing the second terminal housing 7 may be formed in a tapered shape, and the housing waterproof structure 21 may be formed around the outer portion at the one end of the cylindrical body 36.

In the other end (in the figure, in the right end) of the cylindrical body 36 is accommodated the cable holding member 30 with the cables 27*a* to 27*c* aligned and held therewith. On a cable insertion side of the cable holding member 30 is formed a packingless sealing portion 37, to prevent water from penetrating onto the cables 27*a* to 27*c* and into the second terminal housing 7. In an outer portion of the cable holding member 30 is provided a packing 38 to be in contact with an inner surface of the first terminal housing 5. That is, the connector 1 has a double waterproofing structure of the packing 23 of the terminal housing waterproofing structure 21 and the packing 38 provided in the outer portion of the cable holding member 30.

Further, the other end of the cylindrical body 36 from which the cables 27*a* to 27*c* are drawn out is covered with a rubber boot 39 for preventing water from penetrating into the cylindrical body 36.

Also, in an upper portion (in the figure, in the upper side) of the cylindrical body 36 is formed a connecting member manipulation hole 40 for manipulating the connecting member 9 provided in the first connector portion 2 when the first connector portion 2 and the second connector portion 3 are mated with each other.

For shielding performance, heat dissipation, and weight reduction of the connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of an insulating resin. Therefore, to enhance its shielding performance and heat dissipation, the cylindrical shield body 41 made of aluminum is provided on an inner surface at the other end of the cylindrical body 36.

The cylindrical shield body 41 has a contact 42 to be contacted with an outer portion of the first terminal housing 5 made of an aluminum when the first connector portion 2 and the second connector portion 3 are mated with each other. The cylindrical shield body 41 is thermally and electrically connected with the first terminal housing 5 via this contact 42. This enhances the shielding performance and the heat dissipation. In particular, the heat dissipation is likely to be significantly enhanced by positively allowing heat to escape toward the first terminal housing 5 having an excellent heat dissipation property.

Herein, the connector 1 in this embodiment is used in the vibrational environment such as on-vehicle, so that the connecting terminals are moved relatively to each other due to the fretting (micro sliding). Therefore, there is a problem of the fretting corrosion (abrasion, wear) between the connecting terminals at the contacts.

For example, Sn-plating is provided on a surface of the connecting terminal so as to obtain low contact resistance stably. However, when the connecting terminal is abraded due to the fretting, the Sn-plating on the surface of the connecting terminal is scraped to generate wear debris. The wear debris are oxidized and deposited on the surface, and the connecting terminal runs upon the oxidized wear debris when the connecting terminals are mated, thereby increasing the contact resistance.

So as to solve the above problem, namely to enhance a fixing force of the connecting terminal, the connector 1 in this embodiment is configured as follows. The first connecting terminals 4*a* to 4*c* and the second connecting terminals 6*a* to 6*c* are respectively surface-roughened such that a surface (i.e. composing a contact) of one connecting terminal facing to the other connecting terminal provides a first frictional coefficient $\mu_1$. When the isolating plates 8*a* to 8*c* are adjacent to the first connecting terminals 4*a* to 4*c*, the isolating plates 8*a* to 8*c* are integrally fixed to the first connecting terminals 4*a* to 4*c*, respectively. In the meantime, when the isolating plates 8*b* to 8*d* are adjacent to the second connecting terminals 6*a* to 6*c*, surfaces of the isolating plates 8*b* to 8*d* which face to the second connecting terminals 6*a* to 6*c* are surface-roughened to provide a second frictional coefficient $\mu_2$.

Herein, the first frictional coefficient $\mu_1$ means a coefficient of static friction between the first connecting terminals 4*a* to 4*c* and the second connecting terminals 6*a* to 6*c*. The second frictional coefficient $\mu_2$ means a coefficient of static friction between the second connecting terminals 6*a* to 6*c* and the isolating plates 8*b* to 8*d*.

In other words, "the first connecting terminals 4*a* to 4*c* and the second connecting terminals 6*a* to 6*c* are surface-roughened to provide the first frictional coefficient $\mu_1$" means that the first connecting terminals 4*a* to 4*c* and the second connecting terminals 6*a* to 6*c* are surface-roughened such that a coefficient of static friction between the first connecting terminals 4*a* to 4*c* and the second connecting terminals 6*a* to 6*c* is the first frictional coefficient $\mu_1$. Similarly, "the isolating plates 8*b* to 8*d* are surface-roughened to provide the second frictional coefficient $\mu_2$" means that the isolating plates 8*b* to 8*d* are surface-roughened such that a coefficient of static friction between the second connecting terminals 6*a* to 6*c* and the isolating plates 8*b* to 8*d* is the second frictional coefficient $\mu_2$.

Preferably, the first frictional coefficient $\mu_1$ and the second frictional coefficient $\mu_2$ are substantially identical to each other. More concretely, both of the first frictional coefficient $\mu_1$ and the second frictional coefficient $\mu_2$ are preferably greater than 1. According to this structure, integrality of stacked state of the first connecting terminals 4*a* to 4*c*, the second connecting terminals 6*a* to 6*c* and the isolating plates 8*a* to 8*d* is enhanced, thereby improving a coupling force therebetween.

As a method for surface-roughening, rubber-coating, sandblasting, knurling process, alumite treatment or the like may be used.

Herein, the alumite treatment is a method of anodizing aluminum or aluminum alloy to form an oxide coating on a surface of the aluminum or aluminum alloy. The alumite treatment is in general used for improving corrosion resistance characteristic and abrasion resistance characteristic. It is also possible to increase the fictional coefficient by controlling the growth of the coating.

For example, as shown in FIGS. 9A, 9B, 10A, 10B and 11A and 11B, knurling process is carried out on lower surfaces of the first connecting terminals 4*a* to 4*c* (and the second connecting terminals 6*a* to 6*c*) and upper surfaces of the isolating plates 8*b* to 8*d*, the integral stacked state is realized, thereby improving the coupling force therebetween. In FIGS. 9A, 9B, 10A, 10B and 11A and 11B, FIGS. 9A, 10A and 11A show the views of the upper surfaces of the isolating plates 8*b* and 8*c* as shown in FIG. 5 and FIGS. 9B, 10B and 11B show the views of the lower surfaces of the first connecting terminals 4*b* and 4*c* as shown in FIG. 5.

(Operation and Function of the Connector 1)

Next is described the operation and function of the connector 1 in this embodiment.

Figure 12:
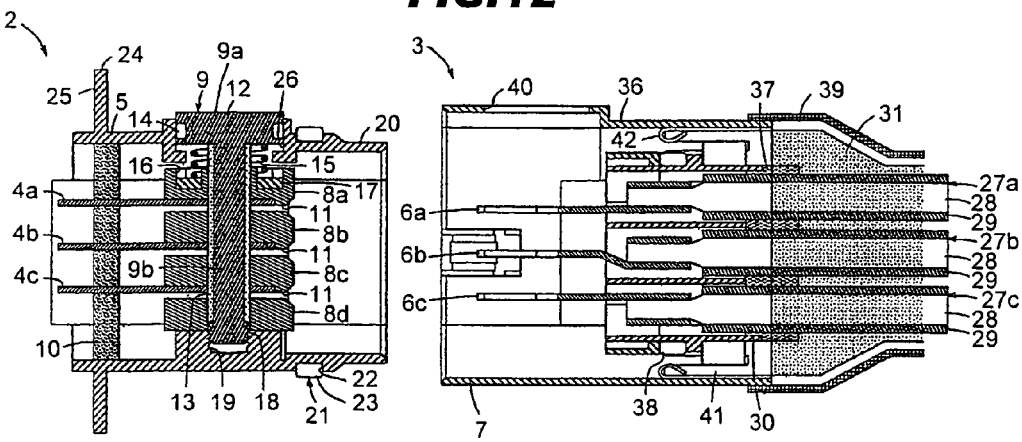
FIG. 12 is a cross sectional view of the connector in the first embodiment before the first connector portion and the second connector portion are mated.

When the first connector portion 2 and the second connector portion 3 are mated with each other from an unmated state as shown in FIG. 12, the second connecting terminals 6*a* to 6*c* are inserted between the first connecting terminal 4*a* with the isolating plate 8*a* and the isolating plate 8*b*, between the first connecting terminal 4*b* with the isolating plate 8*b* and the isolating plate 8*c*, and between the first connecting terminal 4*c* with the isolating plate 8*c* and the isolating plate 8*d*, respectively, where the first connecting terminals 4*a* to 4*c* and the second connecting terminals 6*a* to 6*c* form pairs respectively. With that insertion, the first connecting terminals 4*a* to 4*c* and the second connecting terminals 6*a* to 6*c* then face each other to form pairs, respectively, and result in a stacked structure in which the pairs of the first connecting terminals 4*a* to 4*c* and the second connecting terminals 6*a* to 6*c* and the isolating plates 8*a* to 8*d* are disposed alternately, i.e. the pairs of the first connecting terminals 4*a* to 4*c* and the second connecting terminals 6*a* to 6*c* are alternately interleaved with the isolating plates 8*a* to 8*d*.

In this case, inside the first connector portion 2, the isolating plates 8*a* to 8*c* are respectively fixed to the tips of the first connecting terminals 4*a* to 4*c* held to be aligned at a specified pitch. A pitch between the isolating plates 8*a*, 8*b* and 8*c* can therefore be held, even without separately providing a holding jig (see JP Patent No. 4037199) for holding the pitch between the isolating plates 8*a*, 8*b* and 8*c*. This allows the second connecting terminals 6*a* to 6*c* to be easily inserted between the first connecting terminal 4*a* with the isolating plate 8*a* and the isolating plate 8*b*, between the first connecting terminal 4*b* with the isolating plate 8*b* and the isolating plate 8*c*, and between the first connecting terminal 4*c* with the isolating plate 8*c* and the isolating plate 8*d*, respectively, where the first connecting terminals 4*a* to 4*c* and the second connecting terminals 6*a* to 6*c* form the pairs respectively. That is, the insertability/removability of the second connecting terminals 6*a* to 6*c* is unlikely to deteriorate. Also, because of no need to provide a holding jig for holding the pitch between the isolating plates 8*a*, 8*b* and 8*c*, a further size reduction can very effectively be achieved, compared to the prior art.

Also, the contact between the first connecting terminal 4*a* (or 4*b*) and the second connecting terminal 6*a* (or 6*b*) is sandwiched between the first isolating plate 8*a* (or 8*b*) fixed to the first connecting terminal 4*a* (or 4*b*) constituting the contact, and the first isolating plate 8*b* (or 8*c*) fixed to the first connecting terminal 4*b* (or 4*c*) constituting the other contact. Likewise, the contact between the first connecting terminal 4*c* and the second connecting terminal 6*c* is sandwiched between the first isolating plate 8*c* fixed to the first connecting terminal 4*c* constituting the contact, and the second isolating plate 8*d* fixed to the inner surface of the first terminal housing 5.

Referring to FIG. 3, following that, the connecting member 9 is manipulated through the connecting member manipulation hole 40, to screw and tighten the screwing portion 18 of the connecting member 9 into the screw hole 19 of the first terminal housing 5. The connecting member 9 is then rotated and pressed into the bottom of the screw hole 19, and causes the elastic member 15 to, in turn, press the first isolating plate 8*a*, the first isolating plate 8*b*, the first isolating plate 8*c*, and the second isolating plate 8*d*, and sandwich the contacts between the isolating plates 8*a* and 8*b*, between the isolating plates 8*b* and 8*c*, and between the isolating plates 8*c* and 8*d*, respectively, with the contacts isolated from each other. In this case, by being pressed by the isolating plates 8*c* and 8*d*, the first connecting terminals 4*a* to 4*c* and the second connecting terminals 6*a* to 6*c* are slightly bent and contacted with each other, respectively, in a wide range. Further, since the surfaces of the first connecting terminals 4*a* to 4*c*, the second connecting terminals 6*a* to 6*c*, and the isolating plates 8*b* to 8*d* are roughened, the integral stacked state is enhanced and the coupling therebetween is improved. According to this structure, the fretting corrosion at the contacts can be reduced.

In particular, when the first connecting terminals 4*a* to 4*c* are adjacent to each other, the number of the locations where the fretting occurs can be reduced by three, by configuring such that the isolating plates 8*a* to 8*c* are integrally fixed to the first connecting terminals 4*a* to 4*c*. Therefore, the fretting corrosion at the contacts can be reduced more effectively.

Figure 13:
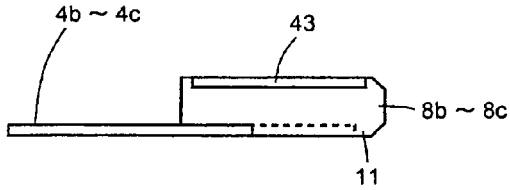
FIG. 13 is a side view of the isolating plate in a variation of the first embodiment.

In this embodiment, the upper surfaces of the isolating plates 8*b* to 8*d* are surface-roughened to provide the second frictional coefficient $\mu_2$, however, the present invention is not limited thereto. Alternatively, as shown in FIG. 13, a metallic plate 43 having a surface for providing the second frictional coefficient $\mu_2$ may be fixed on the upper surface of each of the isolating plates 8*b* to 8*d*, which faces to each of the second connecting terminals 6*a* to 6*c*. According to this structure, the effect similar to that of this embodiment can be provided. In FIG. 13, the first connecting terminals 4*b* and 4*c* and the isolating plates 8*b* and 8*c* are shown as example.

Also, although in this embodiment, the first connecting terminals 4*a* to 4*c* and the second connecting terminals 6*a* to 6*c* are in surface contact with each other respectively, the first connecting terminal 4*a* to 4*c* contact side surfaces to be contacted with the second connecting terminals 6*a* to 6*c* may be formed with protruding portions, and U-shaped contacts 33 of the second connecting terminals 6*a* to 6*c* may be configured to be mated onto these protruding portions, respectively. This configuration allows the further stabilization of the coupling force of the first connecting terminals 4*a* to 4*c* and the second connecting terminals 6*a* to 6*c*, respectively. That is, this configuration is especially effective for vibration perpendicular to the connecting member 9.

Also, although in this embodiment, lengths of branch tips of each U-shaped contact 33 of the second connecting terminals 6*a* to 6*c* are the same, one length thereof may be formed to be long to form a J-shaped contact. The J-shaped contact allows the second connector portion 3 to be inserted into the shaft 9*b* of the connecting member 9 obliquely relative to the cable longitudinal direction.

Although in this embodiment, the screw hole 19 is formed at such a position as to be screwed onto the screwing portion 18 at the tip of the connecting member 9, the screwing portion 18 may be formed in the head 9*b* of the connecting member 9, and the screw hole 19 may be formed to be screwed onto the screwing portion 18 formed in the head 9*b*. Also, although in this embodiment, the screw hole 19 is formed in the first terminal housing 5, only a through hole, not the screw hole 19 may be formed in the first terminal housing 5, and the screw hole 19 may be formed in the second terminal housing 7. Also, the screw hole 19 may be formed both in the first terminal housing 5 and the second terminal housing 7.

Although the connector 1 in this embodiment has been described, one of the features of the connector 1 in this embodiment is that, unlike a later-described connector 100 in a second embodiment, the shaft 9*b* of the connecting member 9 penetrates each contact between the first connecting terminals 4*a* to 4*c* and the second connecting terminals 6*a* to 6*c* and the isolating plates 8*a* to 8*d*. This configuration allows the facilitation of the constant respective positional relationships of between the first connecting terminals 4*a* to 4*c* and the second connecting terminals 6*a* to 6*c* relative to the connecting member 9 as a center.

Second Embodiment

Figure 14:
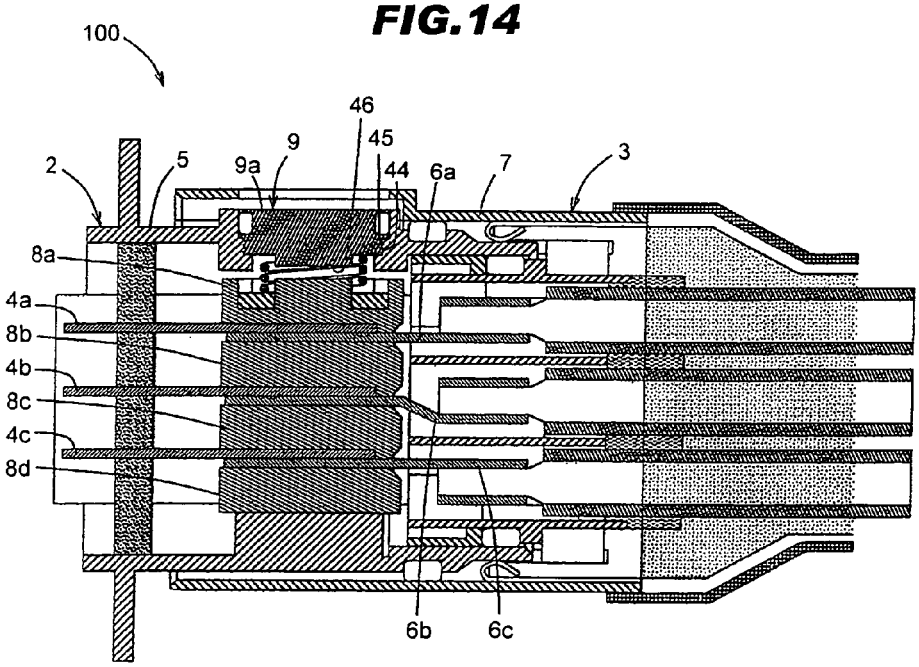
FIG. 14 is a cross sectional view of a connector in a second embodiment when the first connector portion and the second connector portion are mated.

Next is described a connector 100 in a second embodiment according to the invention, referring to FIG. 14.

(Connector 100 Structure)

As shown in FIG. 14, the connector 100 in this embodiment is different from the previously described connector 1 in the first embodiment in that the connecting member 9 does not penetrate each contact between the first connecting terminals 4*a* to 4*c* and the second connecting terminals 6*a* to 6*c* and the isolating plates 8*a* to 8*d*. That is, in this embodiment, the connecting member 9 is consisted of only the head 9*a* serving as the pressing portion.

In the connector 1 in the first embodiment, the screwing portion 18 formed in the shaft 9*b* is screwed into the screw hole 19 of the first terminal housing 5 to thereby tighten the connecting member 9 into the first terminal housing 5, whereas in the connector 100 in this embodiment, the connecting member 9 is formed of only the head 9*a*, and the connector 100 is therefore configured so that a male screwing portion 43 is formed in such a manner as to avoid the packing 14 around the head 9*a*, while a female screw 44 into which the screwing portion 43 is screwed is cut in an inner portion of the connecting member insertion hole 26 of the first terminal housing 5, to screw the screwing portion 43 into the female screw 44 and thereby tighten the connecting member 9 into the first terminal housing 5.

As shown in FIG. 14, the head 9*a* is shaped to have a large diameter portion provided with the packing 14 and a small diameter portion formed with the male screwing portion 44, and to shape the connecting member insertion hole 26 to have those two diameter dimensions. With this configuration, when the head 9*a* is tightened into the connecting member insertion hole 26, the male screwing portion 44 is not disposed in a portion facing the packing 14. This can therefore ensure its effective waterproofing structure.

Also, on a lower surface of the head 9*a* of the connecting member 9 (on the lower surface facing the first isolating plate 8*a*) is formed an elastic member holding portion 45 for engaging and holding the elastic member 15. The elastic member 15 is held by this elastic member holding portion 45 to form a portion of the connecting member 9.

The connection of the first connecting terminals 4*a* to 4*c* and the second connecting terminals 6*a* to 6*c* using this connector 100 is performed in the same procedure as that of the previously described connector 1 in the first embodiment. That is, the mating of the first connector portion 2 and the second connector portion 3 is followed by tightening the male screwing portion 43 of the connecting member 9 into the female screw 44 of the first terminal housing 5, concurrently with this, sequentially exerting the pressing force of the elastic member 15 to the isolating plates 8*a* to 8*d*, and pressing the contacts to be sandwiched between the isolating plates 8*a* and 8*b*, 8*b* and 8*c*, and 8*c* and 8*d*, respectively, to thereby connect the first connecting terminals 4*a* to 4*c* and the second connecting terminals 6*a* to 6*c*, respectively. This allows the first connecting terminals 4*a* to 4*c* and the second connecting terminals 6*a* to 6*c* to be firmly fixed to each other respectively.

Also, in this embodiment, since the connecting member 9 does not penetrate each contact between the first connecting terminals 4*a* to 4*c* and the second connecting terminals 6*a* to 6*c* and the isolating plates 8*a* to 8*d*, there is no need to form the contacts of the second connecting terminals 6*a* to 6*c* in such a shape as to avoid the connecting member 9 (e.g. in the previously mentioned U-shape).

Although the connector 100 in the second embodiment has been described, one of the features of the connector 100 in the second embodiment is that, unlike the previously described connector 100 in the first embodiment, the connecting member 9 does not penetrate each contact between the first connecting terminals 4*a* to 4*c* and the second connecting terminals 6*a* to 6*c* and the isolating plates 8*a* to 8*d*. This configuration results from fixing the isolating plates 8*a* to 8*c* to the other surfaces of the first connecting terminals 4*a* to 4*c* respectively, and can ensure the cost reduction of the connecting member 9. Also, this leads to the weight reduction of the connecting member 9, thus allowing a contribution to the weight reduction of the entire connector.

The invention is not limited to the above-described embodiments, but various alterations are possible in the scope not departing from the gist of the invention.

Also, although in this embodiment, three phase alternating power lines have been assumed, according to the technical idea of the invention, the connector for a vehicle, for example, may be configured to collectively connect lines for different uses, such as three phase alternating current power lines for between a motor and an inverter, two phase direct current power lines for an air conditioner, and the like. This configuration allows power lines for a plurality of uses to be collectively connected by one connector. There is therefore no need to prepare a different connector for each use, to thereby allow a contribution to space saving or low cost.

Also, although in this embodiment, when viewed from the head 9*a* of the connecting member 9, the first connecting terminals 4*a* to 4*c* and the second connecting terminals 6*a* to 6*c* have been configured to be linearly contacted with each other respectively, the first terminal housing 5 and the second terminal housing 7 may be configured so that, when viewed from the head 9*a* of the connecting member 9, the first connecting terminals 4*a* to 4*c* of the first connector portion 2 cross and contact the second connecting terminals 6*a* to 6*c* of the second connector portion 3 respectively at a right angle thereto. That is, the first connector portion 2 and the second connector portion 3 may be mated with each other in an L-shape. Likewise, the second terminal housing 7 and the second connecting terminals 6*a* to 6*c* may be configured to be disposed obliquely relative to the first terminal housing 5 and the first connecting terminals 4*a* to 4*c* respectively. By thus applying the gist of the invention, the direction of inserting/removing the second connector portion 3 relative to the first connector portion 2 may be varied. That is, the direction of drawing the cables out from the connector can be mated to the shape of an installation portion, to thereby allow a contribution to space saving.

Also, although in this embodiment it has been described that, unlike the second connecting terminals 6*a* to 6*c*, the first connecting terminals 4*a* to 4*c* are not connected with cables respectively, the first connecting terminals 4*a* to 4*c* are not limited to this structure. The connector 100 in this embodiment may be used for connecting cables to each other.

Also, although in this embodiment, the cables 27*a* to 27*c* used have excellent flexibility, rigid cables may be used.

Also, although in this embodiment, the bolt 12 has been described as the example of the connecting member 9, the connecting member 9 configuration is not limited to bolt shape. For example, a shaft of a CPA (Connector Position Assurance) lever which fixes mating between the first connector portion 2 and the second connector portion 3 may be configured as the connecting member 9, in which the CPA lever is rotated to fix the mating and to press (or tighten) the connecting member 9 from the head 9*a* of the connecting member 9 toward a tip end of the shaft 9*b*.

Also, in this embodiment, the head 9*a* of the bolt 12 as the connecting member 9 is formed with a recess in its upper surface (more specifically, at the center of the upper surface), into which a hexagon wrench (hexagonal spanner) is mated. Although in this embodiment, the specified manipulation tool has been assumed as being a commercial hexagon wrench, the head 9*a* of the bolt 12 as the connecting member 9 may be formed with a recess having a shape corresponding to the specified manipulation tool that is not commercialized, with assuming that the non-commercial specified manipulation tool is used.

Also, in this embodiment, the use orientation of the connector is such that the connecting member 9 may be substantially horizontal or substantially vertical. In other words, the use conditions of the connector in this embodiment require no use orientation.

Also, although in this embodiment, the head 9*b* of the connecting member 9 is pressed against the adjacent isolating plate 8*a* via the elastic member 15 constituting a portion of the connecting member 9, the head 9*b* may be pressed directly against the adjacent isolating plate 8*a*, not via the elastic member 15.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A connection structure for a vehicle, comprising:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, when the first terminal housing and the second terminal housing being mated with each other, the first connecting terminals and the second connecting terminals facing each other to form pairs, respectively, and resulting in a stacked structure of the isolating plates being sandwiched between the pairs of the first connecting terminals and the second connecting terminals, respectively; and a connecting member for pressing the adjacent isolating plate, to thereby collectively fix the first connecting terminals and the second connecting terminals at the contacts therebetween, for electrical connections between the first connecting terminals and the second connecting terminals, respectively, wherein each of the first connecting terminals and each of the second connecting terminals are surface-roughened such that a surface facing to other connecting terminal composing a contact provides a first frictional coefficient, wherein when each of the isolating plates is adjacent to each of the first connecting terminals, each of the isolating plates is integrally fixed to each of the first connecting terminals, and when each of the isolating plates is adjacent to each of the second connecting terminals, each surface of the isolating plates facing to each of the second connecting terminals is surface-roughened to provide a second frictional coefficient, wherein each of the first connecting terminals, each of the second connecting terminals and each of the isolating plates are integrally coupled with each other to suppress movement relative to each other against fretting, when each contact between the first connecting terminals and the second connecting terminals and the isolating plates are pressed by the connecting member.

2. The connection structure for a vehicle, according to claim 1, wherein the first terminal housing comprises a male terminal housing, the second terminal housing comprises a female terminal housing, and the second terminal housing further comprises a through-hole configured to allow the connecting member to be inserted into and removed from the first terminal housing after the first terminal housing and the second terminal housing are mated.

3. The connection structure for a vehicle, according to claim 1, wherein the first frictional coefficient and the second frictional coefficient are substantially identical to each other.

4. The connection structure for a vehicle, according to claim 1, wherein a flexible cable is connected to one end of each of the second connecting terminals and the second terminal housing, and the second terminal housing is provided with a cable holding member that allows the second connecting terminals to be held with flexibility at specified positions respectively by holding the cable.

5. The connection structure for a vehicle, according to claim 1, wherein the connecting member comprises a head and a shaft connected to the head, the shaft penetrates each contact between the first connecting terminals and the second connecting terminals as well as the isolating plates, the head presses the adjacent isolating plate, to thereby collectively fix the first connecting terminals and the second connecting terminals at the contacts therebetween, and at least a portion of the connecting member, which penetrates each contact, is formed of an insulating material.

6. The connection structure for a vehicle, according to claim 5, wherein a connecting member insertion hole for inserting the connecting member is formed in the first terminal housing, at least a portion of the shaft, which penetrates the first connecting terminals and the second connecting terminals, has a surface formed of an insulating material, the head is integrally formed with the shaft, and a waterproofing structure for sealing between an outer surface of the head and an inner surface of the connecting member insertion hole in the male terminal housing is provided in an outer surface of the head of the connecting member.

7. The connection structure for a vehicle, according to claim 5, wherein the first terminal housing comprises a male terminal housing, the second terminal housing comprises a female terminal housing, and the second terminal housing further comprises a through-hole configured to allow the connecting member to be inserted into and removed from the first terminal housing after the first terminal housing and the second terminal housing are mated.

8. The connection structure for a vehicle, according to claim 5, wherein the first frictional coefficient and the second frictional coefficient are substantially identical to each other.

9. The connection structure for a vehicle, according to claim 5, wherein a flexible cable is connected to one end of each of the second connecting terminals and the second terminal housing, and the second terminal housing is provided with a cable holding member that allows the second connecting terminals to be held with flexibility at specified positions respectively by holding the cable.

10. A connection structure for a vehicle, comprising:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, when the first terminal housing and the second terminal housing being mated with each other, the first connecting terminals and the second connecting terminals facing each other to form pairs, respectively, and resulting in a stacked structure of the isolating plates being sandwiched between the pairs of the first connecting terminals and the second connecting terminals, respectively; and a connecting member for pressing the adjacent isolating plate, to thereby collectively fix the first connecting terminals and the second connecting terminals at the contacts therebetween, for electrical connections between the first connecting terminals and the second connecting terminals, respectively, wherein each of the first connecting terminals and each of the second connecting terminals are surface-roughened such that a surface facing to other connecting terminal composing a contact provides a first frictional coefficient, wherein when each of the isolating plates is adjacent to each of the first connecting terminals, each of the isolating plates is integrally fixed to each of the first connecting terminals, and when each of the isolating plates is adjacent to each of the second connecting terminals, a metallic plate having a roughened surface to provide a second frictional coefficient is provided on a surface of each of the isolating plates facing to each of the second connecting terminals, wherein each of the first connecting terminals, each of the second connecting terminals and each of the isolating plates are integrally coupled with each other to suppress movement relative to each other against fretting, when each contact between the first connecting terminals and the second connecting terminals and the isolating plates are pressed by the connecting member.

11. The connection structure for a vehicle, according to claim 10, wherein the first terminal housing comprises a male terminal housing, the second terminal housing comprises a female terminal housing, and the second terminal housing further comprises a through-hole configured to allow the connecting member to be inserted into and removed from the first terminal housing after the first terminal housing and the second terminal housing are mated.

12. The connection structure for a vehicle, according to claim 10, wherein the first frictional coefficient and the second frictional coefficient are substantially identical to each other.

13. The connection structure for a vehicle, according to claim 10, wherein a flexible cable is connected to one end of each of the second connecting terminals and the second terminal housing, and the second terminal housing is provided with a cable holding member that allows the second connecting terminals to be held with flexibility at specified positions respectively by holding the cable.

14. The connection structure for a vehicle, according to claim 10, wherein the connecting member comprises a head and a shaft connected to the head, the shaft penetrates each contact between the first connecting terminals and the second connecting terminals as well as the isolating plates, the head presses the adjacent isolating plate, to thereby collectively fix the first connecting terminals and the second connecting terminals at the contacts therebetween, and at least a portion of the connecting member, which penetrates each contact, is formed of an insulating material.

15. The connection structure for a vehicle, according to claim 14, wherein a connecting member insertion hole for inserting the connecting member is formed in the first terminal housing, at least a portion of the shaft, which penetrates the first connecting terminals and the second connecting terminals, has a surface formed of an insulating material, the head is integrally formed with the shaft, a waterproofing structure for sealing between an outer surface of the head and an inner surface of the connecting member insertion hole in the male terminal housing is provided in an outer surface of the head of the connecting member.

16. The connection structure for a vehicle, according to claim 14, wherein the first terminal housing comprises a male terminal housing, the second terminal housing comprises a female terminal housing, and the second terminal housing further comprises a through-hole configured to allow the connecting member to be inserted into and removed from the first terminal housing after the first terminal housing and the second terminal housing are mated.

17. The connection structure for a vehicle, according to claim 14, wherein the first frictional coefficient and the second frictional coefficient are substantially identical to each other.

18. The connector according to claim 14, wherein a flexible cable is connected to one end of each of the second connecting terminals and the second terminal housing, and the second terminal housing is provided with a cable holding member that allows the second connecting terminals to be held with flexibility at specified positions respectively by holding the cable.

* * * * *